US008780142B2

(12) United States Patent
Van Den Homberg et al.

(10) Patent No.: US 8,780,142 B2
(45) Date of Patent: Jul. 15, 2014

(54) ACTIVE MATRIX DISPLAY DEVICES AND METHODS OF DRIVING THE SAME

(75) Inventors: John Van Den Homberg, Weert (NL); Hendrik J. Bergveld, Eindhoven (NL); Frans Schoofs, Valkenswaard (NL)

(73) Assignee: Innolux Corporation, Miao-Li County (TW)

( * ) Notice: Subject to any disclaimer, the term of this patent is extended or adjusted under 35 U.S.C. 154(b) by 1472 days.

(21) Appl. No.: 11/816,924

(22) PCT Filed: Feb. 27, 2006

(86) PCT No.: PCT/IB2006/050606

§ 371 (c)(1), (2), (4) Date: Aug. 23, 2007

(87) PCT Pub. No.: WO2006/092757

PCT Pub. Date: Sep. 8, 2006

(65) Prior Publication Data

US 2008/0316163 A1 Dec. 25, 2008

(30) Foreign Application Priority Data

Mar. 2, 2005 (EP) ..... 05101617

(51) Int. Cl.
*G09G 5/10* (2006.01)

(52) U.S. Cl.
USPC ..... 345/690; 345/89; 345/691; 345/692; 345/693; 345/98; 345/204

(58) Field of Classification Search
CPC ..... G09G 3/3685; G09G 3/2014; G09G 2320/029; G09G 2310/0248; G09G 2300/008
USPC ..... 345/98, 82, 208, 211, 206, 81, 87, 204, 345/690–693; 358/1.9, 3.32
See application file for complete search history.

(56) References Cited

U.S. PATENT DOCUMENTS 5,684,501 A * 11/1997 Knapp et al. ..... 345/94
6,369,786 B1 * 4/2002 Suzuki ..... 345/77

(Continued)

FOREIGN PATENT DOCUMENTS

JP 10054988 2/1998 ..... G02F 1/133
JP 10-105124 4/1998 ..... G09G 3/36

(Continued)

OTHER PUBLICATIONS

Office Action from corresponding Chinese patent application 2006800064810, dated Dec. 4, 2009.

(Continued)

*Primary Examiner* — Olga Merkoulova
(74) *Attorney, Agent, or Firm* — McClure, Qualey & Rodack, LLP

(57) ABSTRACT

An active matrix display device has a column driver circuit for providing pixel drive signals to columns of pixels, and comprising current source circuits. Each current source circuit has a supply switch (78) for controlling the time during which the current source supplies current to or drains current from the column. A mapping means (74) derives from a pixel drive level a digital value which represents a time period for the control of the supply switch (78) of each current source circuit. The mapping means (74) implements a single mapping function for use in providing the digital values for all current source circuits. Having a current source circuit for each column facilitates the application of inversion patterns. The conversion of pixel drive levels to values representing time is carried out in a shared manner, so that the required area is kept to a minimum.

27 Claims, 13 Drawing Sheets

(56) References Cited

U.S. PATENT DOCUMENTS

| | | | | |
|---|---|---|---|---|
| 6,567,062 | B1 | 5/2003 | Kudo et al. | 345/92 |
| 6,738,035 | B1 * | 5/2004 | Fan | 345/87 |
| 8,013,826 | B1 * | 9/2011 | Fan | 345/91 |
| 2002/0014628 | A1 * | 2/2002 | Koyama | 257/72 |
| 2004/0070558 | A1 * | 4/2004 | Cok et al. | 345/76 |
| 2004/0207615 | A1 * | 10/2004 | Yumoto | 345/211 |
| 2004/0252084 | A1 | 12/2004 | Miyagawa et al. | 345/76 |
| 2004/0263437 | A1 | 12/2004 | Hattori | 345/76 |
| 2006/0103617 | A1 * | 5/2006 | Yin et al. | 345/89 |
| 2007/0097152 | A1 * | 5/2007 | Hagino et al. | 345/690 |

FOREIGN PATENT DOCUMENTS

| | | | | |
|---|---|---|---|---|
| JP | 11-085115 | | 3/1999 | G09G 3/36 |
| JP | 113035741 | | 11/1999 | G02F 1/133 |
| JP | 2000-194325 | | 7/2000 | G09G 3/36 |
| JP | 2002-023686 | | 1/2002 | G09G 3/20 |
| JP | 2002123230 | | 4/2002 | G02F 1/133 |
| WO | WO2005/057545 | A1 * | 6/2005 | G09G 3/36 |
| WO | WO 2005/057545 | A1 * | 6/2005 | G09G 3/36 |

OTHER PUBLICATIONS

International Search Report, PCT/IB2006/050606, 2 pages, Aug. 29, 2006.

Office Action from Corresponding Japanese Patent Application 2007-557650 dated Sep. 13, 2011, 3 pages.

* cited by examiner

ACTIVE MATRIX DISPLAY DEVICES AND METHODS OF DRIVING THE SAME

This invention relates to active matrix display devices, and particularly to display devices in which an alternative driving scheme is employed, for example Active-Matrix Liquid Crystal Displays (AMLCDs). The invention relates in particular to the integrated driver circuits for such devices.

AMLCDs consist of a large number of liquid crystal pixels, the voltage across which determines their transmittance of light. The pixels are arranged in columns and rows. AMLCDs have on-glass Thin-Film Transistors (TFTs) that form a switch between each LCD pixel and its corresponding column line. The gates of these TFTs are connected together horizontally, so that a gate driver IC can "enable" the rows in a sequential order. The time during which an individual row is selected is referred to as the line addressing time. During the line addressing time, a source driver IC applies voltages to the columns that correspond to the desired transmittance of each pixel in the selected row. Basically, each output of the source driver IC is a buffered DAC output. The basic concept of an AMLCD including gate and source driver IC is illustrated in FIG. 1 for a screen resolution of N rows and M columns with an n-bit colour depth. This implies that each LC pixel can be driven to one out of 2n transmittance levels. As an example, the rows are driven sequentially from top to bottom. Alternative orders are possible depending on the applied scanning algorithm. When all rows have been addressed and all pixels have reached the desired transmittance level, a complete frame has been written and the selection of rows repeats for writing the next frame. Depending on the size/resolution of the LCD screen, several gate driver ICs and several source driver ICs are applied in practical realisations.

Strong demands are imposed on the accuracy of the voltage that is reached on each pixel at the end of each line addressing time. The achieved transmittance of the LCD pixel is determined by the voltage across the capacitance labelled 'LC' in FIG. 1. The bottom plates of these LCD pixels are connected to the common electrode with potential Vcom. Non-idealities in the outputs of the source driver ICs, such as variations in output level between two adjacent columns with identical digital input, will lead to image artefacts and should be minimized. In most LCD screens, an additional capacitor is used in parallel to the LC liquid crystal pixel capacitance for stabilisation of the pixel voltage. The bottom plate of this capacitor can be either connected to Vcom, a separate electrode or an adjacent row-line. This capacitor has been omitted in FIG. 1 for simplicity.

A prerequisite for any LCD driving scheme is that each pixel is driven with an AC signal. This means that when a pixel should have a certain transmittance corresponding to a voltage level Vgreylevel, the source driver IC should address the pixel with a voltage of +Vgreylevel during one frame and with a voltage of −Vgreylevel during the next frame. This is commonly referred to as frame inversion. The transmittance of the LCD pixel is not sensitive to the sign of the applied voltage. In order to implement this in practical source driver ICs, a polarity signal is used in addition to the digital transmittance level signals to determine the sign of the analogue voltage at the outputs of the source driver IC. This signal will toggle between positive and negative from frame to frame for each pixel. Different sequences of polarities are used in each line in practical displays to reduce large area flicker of images. This is defined in the so-called inversion scheme. For example, for dot inversion, adjacent pixels have opposite polarities in the same frame. Any driving scheme applied to AMLCDs should ensure AC drive and allow various inversion schemes.

The translation of the desired transmittance of the LCD pixel into an output voltage of the source driver IC occurs through a so-called gamma curve. This gamma curve is highly non-linear. Since AC drive is required and the complete effective gamma curve is usually asymmetrical (for example caused by the asymmetric signal injection via the gate electrodes of the TFTs), separate gamma curves are used for positive and negative driver output voltages, respectively. In order to allow application of the source driver IC to various LCD screens, the gamma curves should be programmable in a practical device.

A common way of implementing the DAC function in the source driver IC is by using resistor ladders and a selection matrix. Depending on the desired polarity of a pixel, which in conventional drive schemes is the opposite of the polarity in the previous frame, a tap is selected from the ladder implementing the positive gamma curve or the negative gamma curve. This is shown in FIG. 2 for one row and one column.

As can be seen in FIG. 2, both the positive (20) and negative ladder (22) have 2n taps. These ladders are shared, i.e. they generate the reference voltages for all individual selection matrices. Each selection matrix (24) selects one of these levels from either the positive or negative ladder, so 2n+1 lines are fed from the ladders to the selection matrix. In a practical IC implementation the ladders are placed centrally on the IC, whereas the 2n+1 lines are fed over the entire IC, with one selection matrix being used for pairs of columns, because hardware can be shared between adjacent columns when they have opposite polarities (26).

In case of using the concept illustrated in FIG. 2, the colour depth for the display is implemented in the voltage domain. This means that when the colour depth is increased, the number of voltage levels is increased with a factor of 2 for each additional bit. As a consequence, the size of the selection matrices doubles for each extra bit. This is a disadvantage of this set-up.

An alternative is to place the colour depth in the time domain. An example of this can be found in U.S. Pat. No. 6,567,062. The basic structure of the patent is shown in FIG. 3. As mentioned before, an additional capacitor is used in parallel to each liquid crystal cell. A different pixel configuration is used and the gates are addressed with a data signal whose pulse-width is a function of the desired transmittance of the connected LC pixel. This implies that the TFTs are no longer necessarily switched on during the complete line addressing time. The common electrodes have been separated for each line, as opposed to one common electrode for all pixels, and are driven by the "scan-signal driving circuit" 30. This circuit scans the lines sequentially via signals Vy1, Vy2, etc, offered to the isolated common electrodes. Each time a line is scanned, a corresponding "gray-scale voltage selecting circuit" 32 provides a ramp voltage on the drains of all TFTs in that line. This means that the TFT is now used to sample the correct voltage level on the liquid crystal cell by means of using the corresponding pulse-width for driving the gate of the TFT. Therefore, the voltage on the pixel tracks the ramp voltage until the TFT switch is opened by the pulse-width signal, after which the voltage remains stable until the new voltage is written in the next frame. Since the gamma curve is non-linear, the ramp voltage does not need to be a linear ramp, but can be any sort of curve.

A similar approach has been proposed in JP 10054998, JP11305741 and JP 2002123230 and which again involves the use of a ramp voltage, which is tracked by the pixel and then sampled. This system is for panels with one common electrode, as in FIG. 1. The basic structure is shown in FIG. 4. In series with the regular TFT (40), which conducts during the complete line addressing time, an additional TFT (42) is used to sample the wanted value of a ramp voltage on the pixel.

In the circuit of FIG. 5, the sampling switch has been moved into the source driver IC 50 in the form of a transmission gate 52 (NMOS and PMOS switches in parallel), because the additional sampling TFT in FIG. 4 leads to a decrease in light throughput when placed in each pixel and the TFT has poor performance compared to transistors realized in IC-technology silicon. However, the main idea remains the same. The pixel configuration is then the same as in FIG. 1.

With the continuing drive towards increased colour depths of AMLCDs of 10 bits and beyond, the silicon area of these source driver ICs tends to become unacceptably high using existing topologies/architectures and driving schemes, like the driving method using resistor ladders shown in FIG. 2. At the same time, especially for mobile displays with moderate colour depths of 6-8 bits, there is a continuing drive to get cost down for LCD driver ICs, implying lower silicon area.

In resistor ladder layouts, the silicon area needed to implement a colour depth of the LCD screen of n bits scales with 2n. This means that for each additional bit the number of resistor taps doubles, as do the number of switches in the selection matrices, each having a track connected to it that is routed over the entire IC. Since this is inherent to any driving architecture using resistor ladders, this architecture is fundamentally unsuitable for realisation of low silicon-area driver ICs.

An additional disadvantage of using resistor ladders becomes apparent when multiple source driver ICs have to be cascaded for large LCD panels. In that case, some ladder taps of the cascaded ICs need to be connected from IC to IC to prevent voltage-level differences, which would lead to image artefacts. Especially when moving to Chip-on-Glass technology, which will lead to high-ohmic connections between ladders, the accuracy of the ladder-tap voltages could be compromised when the connection resistance becomes roughly the same as the ladder resistance.

The prior art discussed above with reference to FIGS. 3 to 5 shows ways to overcome these problems by realizing the colour depth in the time domain. In this case, a voltage signal with a certain waveform is offered to each column that includes all values to which the column should be charged to cover all possible transmittance values of the addressed pixel. An example of such a waveform is a ramp voltage. For each additional bit, the density in the used time grid increases with a factor of two, but this can be realised in silicon without scaling the area with a factor of two. Moreover, since the translation of a digital transmittance level to an analogue source-driver output is achieved by a translation to a time-period value, which can be implemented in e.g. a digital look-up table (LUT), it is no longer necessary to transport multiple ladder taps from IC to IC in case of cascaded ICs. This also has a positive effect on the programmability of the gamma curves.

The main disadvantage of the time domain driving schemes derives from the use of one ramp voltage which is offered to all columns simultaneously during each line addressing time. This means that in order to realize dot inversion, the ramp voltage should cover all negative and positive gamma voltages in one line addressing time. This has a negative effect on the required time resolution, since a factor of two more time points are needed compared to a voltage waveform that only covers either the negative or positive gamma curve.

Another disadvantage of using a single ramp voltage for all columns simultaneously is the fact that this signal now needs to be generated on a central point on the IC and then needs to be distributed to all columns. Due to the switching nature of the driver ICs in an LCD panel, the danger of coupling of unwanted disturbance signals onto the ramp is realistic. Moreover, the coupling of these disturbance signals to the individual column driver sections will not be equal. This is especially true since the source driver ICs have an exceptional width in practice. This means that the ramp voltages used in the individual column driver outputs will have different disturbance signals superimposed on them, which leads to a difference in column driver outputs, even with identical digital inputs.

An additional disadvantage of the driving method using the arrangement shown in FIG. 3 is the fact that a TFT is used for sampling the correct level of the ramp voltage on the pixel. Due to the applied silicon technology, this TFT transistor has poor performance, including large parasitic overlap capacitances. This means that a relatively large sampling error will be introduced.

A problem of the circuit shown in FIG. 4 is the need for an additional TFT inside each pixel. This leads to a decrease in light throughput and also a TFT is used for sampling. In the second and third version of the patent this is overcome by placing the sampling transistor in the source driver IC.

A general disadvantage of the prior-art discussed above is the influence of series resistance in the path from ramp generator output to pixel. Depending on the RC time of the column resistance and capacitance compared to the line addressing time, the correct end value of the ramp will not be reached on the pixel side of the column. Predistortion of the ramp can compensate for this, but this requires data on both the column resistance and capacitance.

According to the invention, there is provided an active matrix display device comprising:

an array of pixels arranged in rows and columns;

a column driver circuit for providing pixel drive signals to the columns of pixels, wherein the column driver circuit comprises an array of current source circuits, a respective current source circuit being provided for each column of pixels, wherein each current source circuit comprises:

a current source; and a supply switch for controlling the time during which the current source supplies current to or drains current from the column, and wherein the device further comprises a mapping means for deriving from a pixel drive level a digital value which represents a time period for the control of the supply switch of each current source circuit, the mapping means implementing a single mapping function for use in providing the digital values for all current source circuits.

This arrangement provides a current source circuit for each column, and this facilitates the application of inversion patterns, as each column is controlled independently. The control signals that are needed by the current source circuits are timing control signals, rather than signals to be sampled. These control signals can easily be provided across a large area array without loss of information.

The conversion of pixel drive levels to values representing time is carried out in a shared manner, so that the required area is kept to a minimum. It is, nevertheless, possible to calibrate the individual current source circuits independently if required.

The control circuit preferably comprises a look-up table (LUT).

Each current source circuit may comprise a precharge switch for connecting the column to a precharge voltage. This defines the starting point from which each column is charged (or discharged) by the current source circuit.

The current source of each current source circuit may comprise a unipolar current source, and in this case, the precharge voltage is below the lowest pixel drive voltage or above the highest pixel drive voltage.

Alternatively, the current source of each current source circuit can comprise a bidirectional current source, and in this case the precharge voltage is between the lowest pixel drive voltage and the highest pixel drive voltage.

The current source of each current source circuit can supply or drain a constant current over time.

Means may be provided for identifying at least one calibration pixel for use in calibrating the current sources of the current source circuits. For example, the calibration pixel can be identified as one which is driven to a predetermined drive level, such as a maximum or minimum drive level. Sample-and-hold (S&H) circuitry can then be used for storing a drive voltage which results in the calibration pixel after addressing the pixel, and the current output of the current sources of the current source circuits can be adjusted in response to the drive voltage.

This adjustment can be made to the current source rather than to the conversion of pixel data to time values, and this enables calibration of current source circuits for columns or groups of columns in an efficient manner with regard to the amount of space required for the control circuitry.

The invention is of particular benefit in active matrix liquid crystal displays, in which the column driver circuit is adapted to apply a polarity inversion scheme.

The invention also provides a method of driving the pixels of an active matrix display device comprising an array of pixels arranged in rows and columns, the method comprising:

deriving a digital value representing a time period for each column from a pixel drive level for each column using a common mapping of pixel drive levels to digital values;

driving an array of current source circuits, with a respective current source circuit for each column of pixels, each current source circuit being driven for the time value corresponding to the respective digital value.

BRIEF DESCRIPTION OF THE DRAWINGS

Examples of the invention will now be described in detail with reference to the accompanying drawings, in which.

DETAILED DESCRIPTION

The invention provides a column driver circuit in which a current source circuit is used to provide charge to each column for a selected time period. This time period gives rise to an amount of charge which in turn leads to a desired end voltage on the column A look-up table (LUT) is shared by all columns, and individual counters are present at each column for the conversion of a digital value from the LUT to time.

In preferred embodiments, the current source circuits can, however, be individually calibrated. This provides efficient use of substrate area for the column driver circuit whilst enabling accurate control of the pixel brightness output.

The principles underlying the invention are explained with reference to FIG. 6, which shows in schematic form the manner in which columns of pixels are driven in accordance with the invention.

Figure 6:
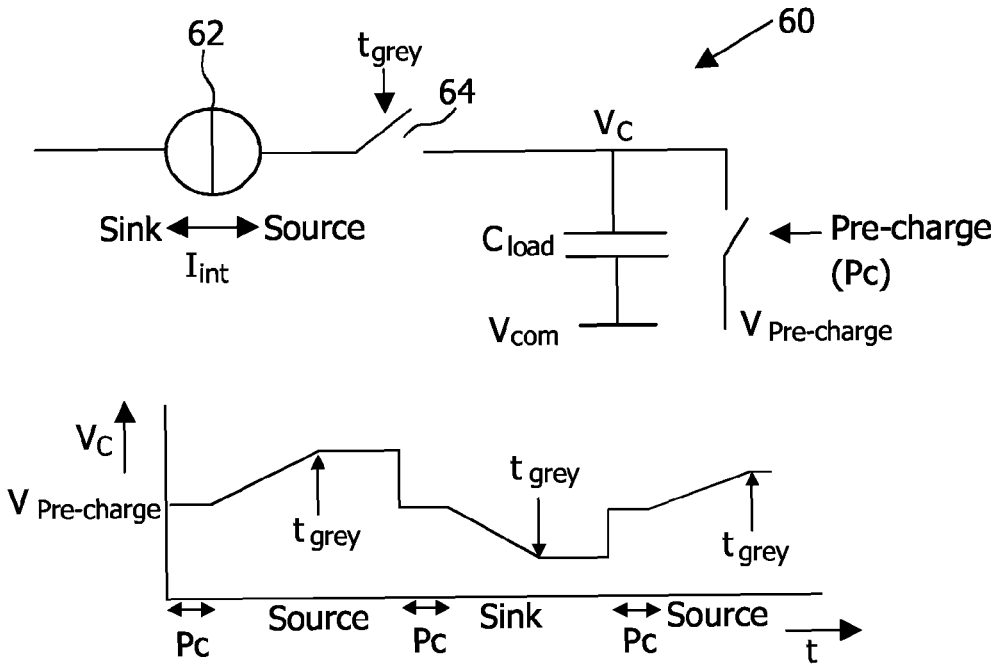
FIG. 6 is used to explain the principles underlying the circuits of the invention.

FIG. 6 shows a single current source circuit 60 (which functions as a column driver) having a current source 62 and a supply switch 64 for controlling the time during which the current source supplies current to or drains current from the column. The bidirectional current source 62 and switch 64 are of course merely a schematic representation of the function, and they may also be implemented by two unipolar current sources each having a switch. Furthermore, the switch function is not necessarily implemented as a series switch with the current source but can be implemented as part of the output interface of the current source. A digital value representing time is derived from a pixel drive level, and a common mapping is used for all columns in obtaining the digital values from the pixel drive levels. This digital data is converted locally into a time period using a local counter (not shown in FIG. 6).

Each column-driver 60 has to drive a capacitive load of column and pixel and the voltage value to which this load capacitance Cload must be driven corresponds to a certain amount of charge stored in Cload. By integrating the current source current output lint in this capacitor Cload during the predetermined amount of time tgrey, the desired voltage end value across the capacitor can be reached. Time tgrey depends on the desired transmittance level. The capacitor starts with a known charge due to a pre-charge (Pc) to a precharge voltage level VPre-charge that is applied at the beginning of the line addressing time. Depending on the desired polarity of the voltage, the current source lint can either sink or source current, as shown schematically in FIG. 6.

A constant value current source is shown in FIG. 6, leading to a ramp voltage on the capacitor, as shown in the lower part of FIG. 6, both for charging and discharging the capacitance. The invention is not, however, limited to a constant current.

Figure 2:
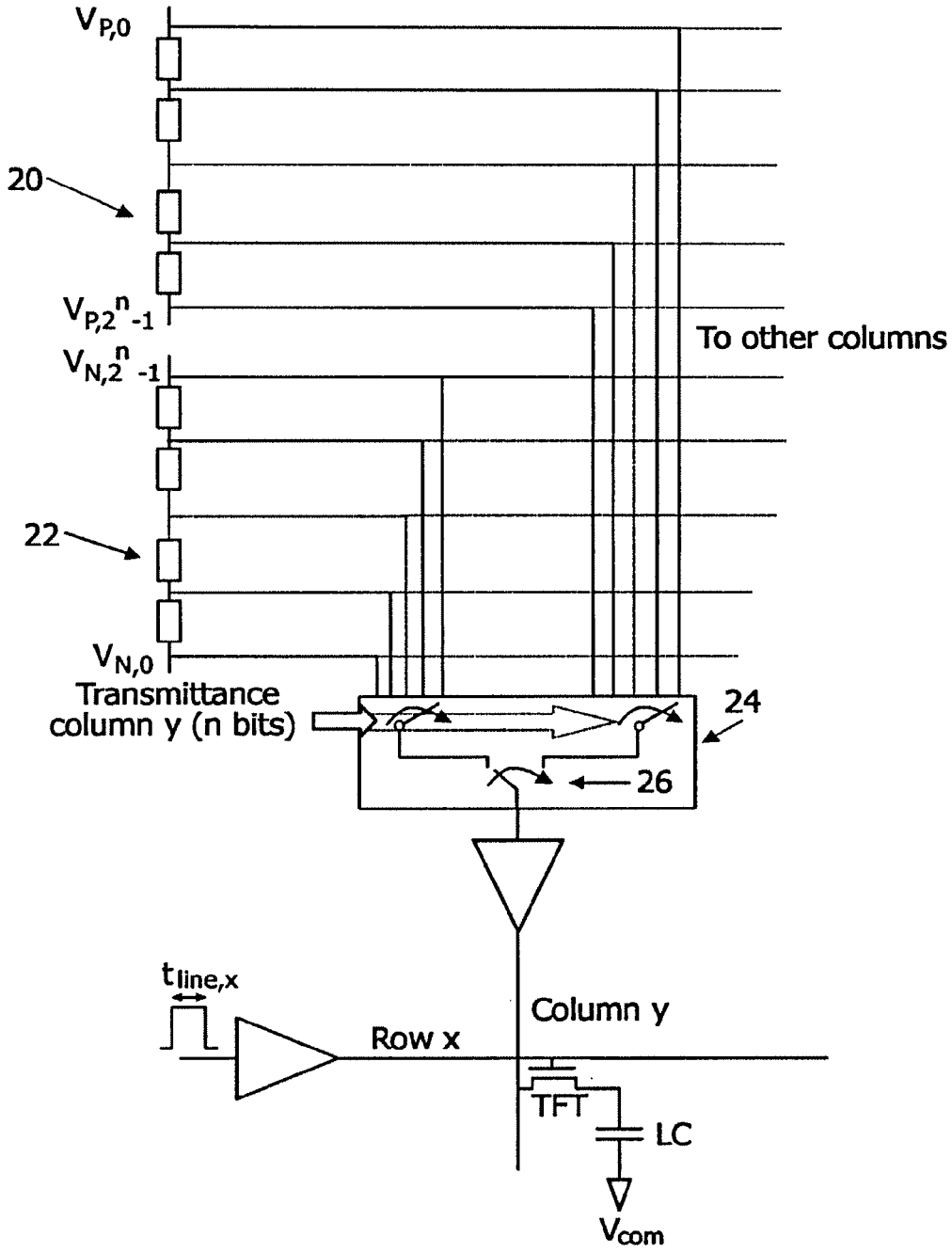
FIG. 2 (PRIOR ART)
FIG. 2 shows the known use of resistor ladders to implement the DAC function in a source driver IC.
Figure 3:
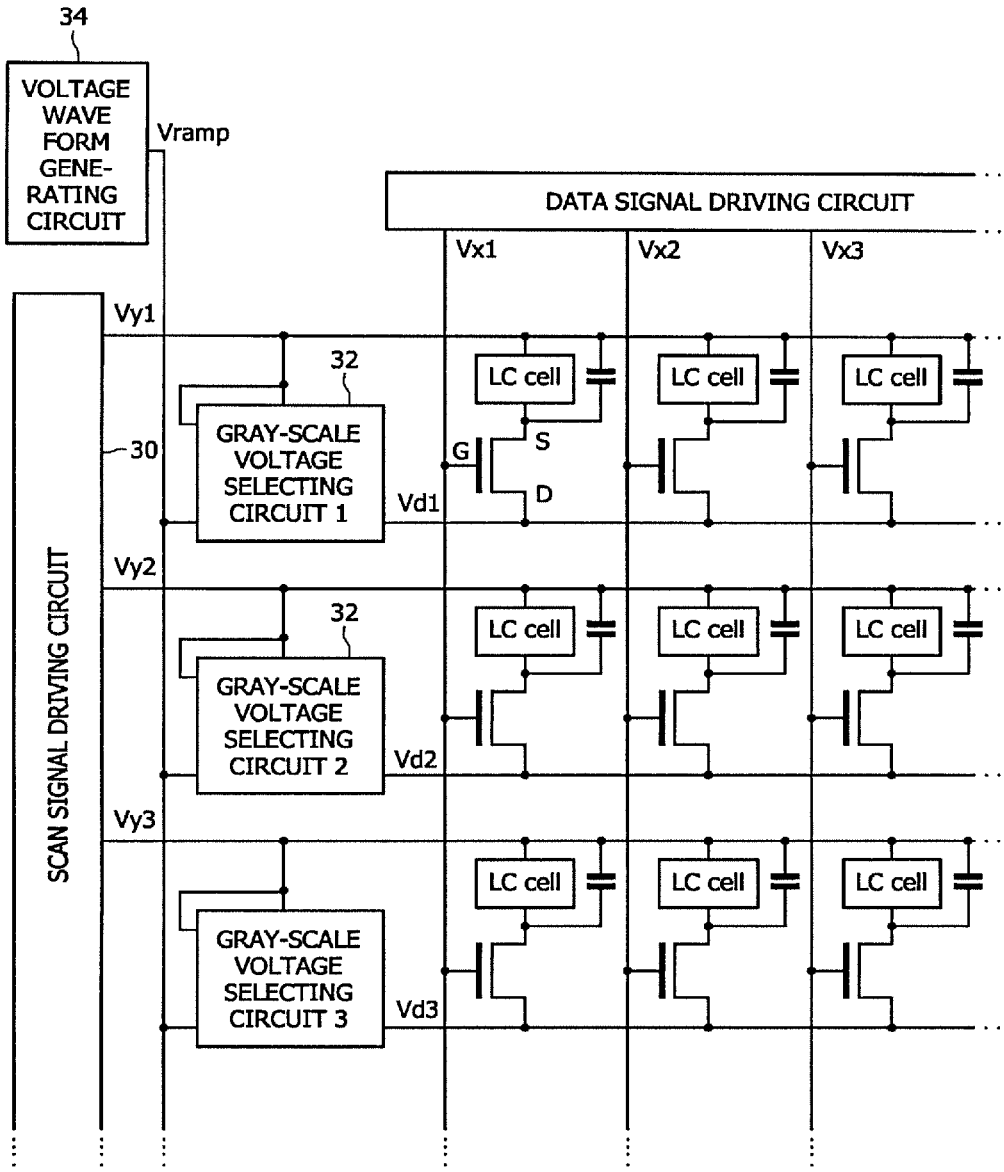
FIG. 3 (PRIOR ART)
FIG. 3 shows a pixel configuration and driving circuit for a driving scheme of U.S. Pat. No. 6,567,062.
Figure 4:
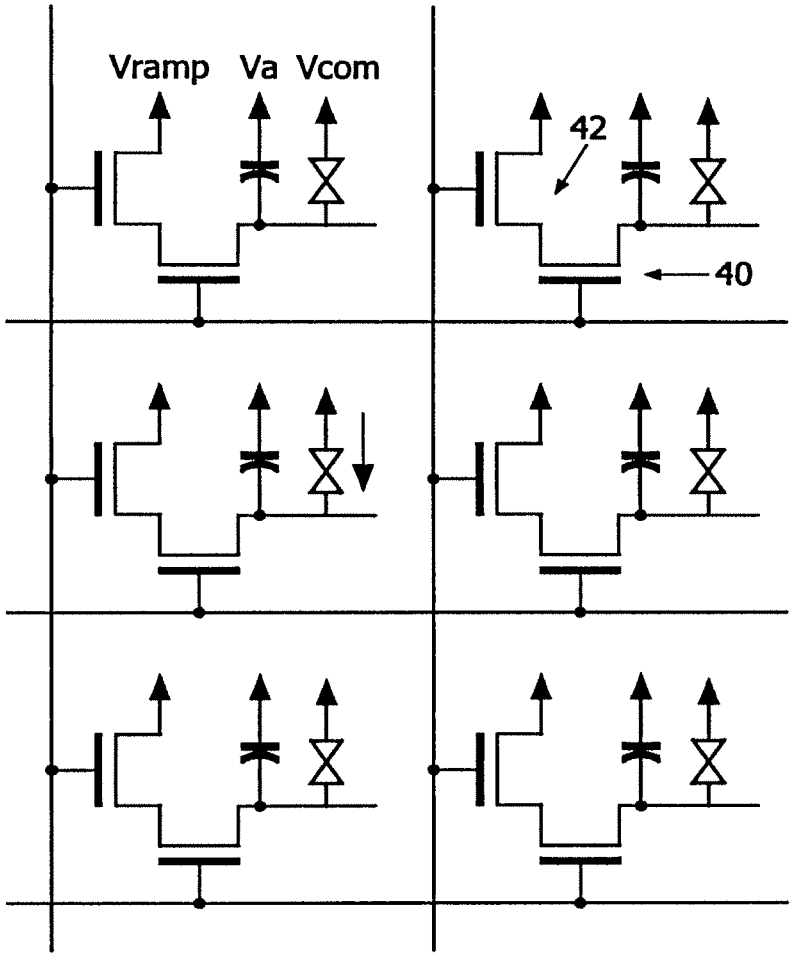
FIG. 4 (PRIOR ART)
FIG. 4 shows a block diagram of a pixel arrangement for a driving scheme of JP10054998.
Figure 5:
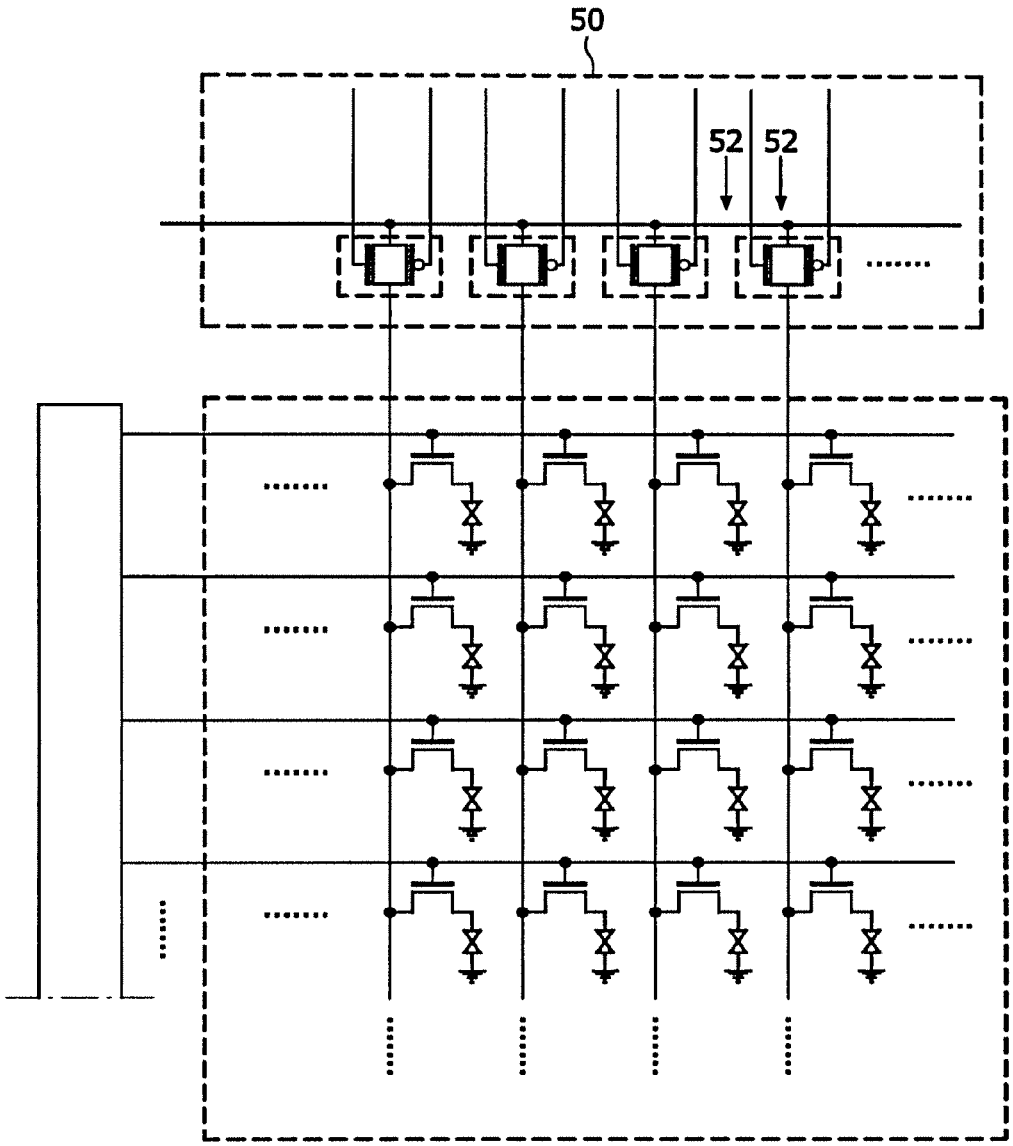
FIG. 5 (PRIOR ART)
FIG. 5 shows a block diagram of a pixel arrangement for a driving scheme of JP11305741.

The main advantage compared to the resistor-ladder architecture of FIG. 2 is that the colour depth is not implemented in the voltage domain, which means that the area does not scale with 2N. Both lint and tgrey determine the charge on Cload. This means that colour depth can be implemented in the current and/or time domain. For varying values of lint the voltage on Cload will have a different shape than shown in FIG. 6.

An additional advantage is that multiple ladder-tap voltages no longer need to be transported from IC to IC in case of cascaded ICs. Instead, a simple digital LUT can be used in each IC, translating the desired transmittance level of a pixel into a combination of lint and tgrey. This enhances the programmability of the gamma curves. The digital LUT may instead be provided off-chip as a central resource which provides functionality to all column driver ICs.

One current source is also used for each column, so that there is no common ramp signal. This means that dot inversion is possible in a simple way, since the current sources in two adjacent columns can flow in opposite directions, leading to a voltage curve covering positive gamma voltages in one column and a voltage curve covering negative gamma voltages in the adjacent column. In this way, half the time resolution is required for a given resolution of the gamma curve, giving rise to simpler implementation. Any inversion scheme can be implemented simply by defining the current direction per column. The problem of a common ramp voltage being fed over the complete large-width IC, which is susceptible to noise pick-up, also is avoided.

Instead of feeding a dynamic ramp signal across the IC, only a reference signal for proper definition of the current source value lint is fed across the IC. It is much simpler to shield such a reference DC value from external disturbances. This has a positive effect on the reduction of image artefacts.

Local calibration loops can be used to make sure that the voltage waveform spanning all gamma voltages, generated by integrating lint in the column and pixel capacitance Cload, reaches a single (or multiple) defined intermediate value(s) during the line addressing time.

Sampling is done in the driver IC with the switch operated by tgrey in FIG. 6, and timing accuracy is easily implemented on the IC.

Figure 1:
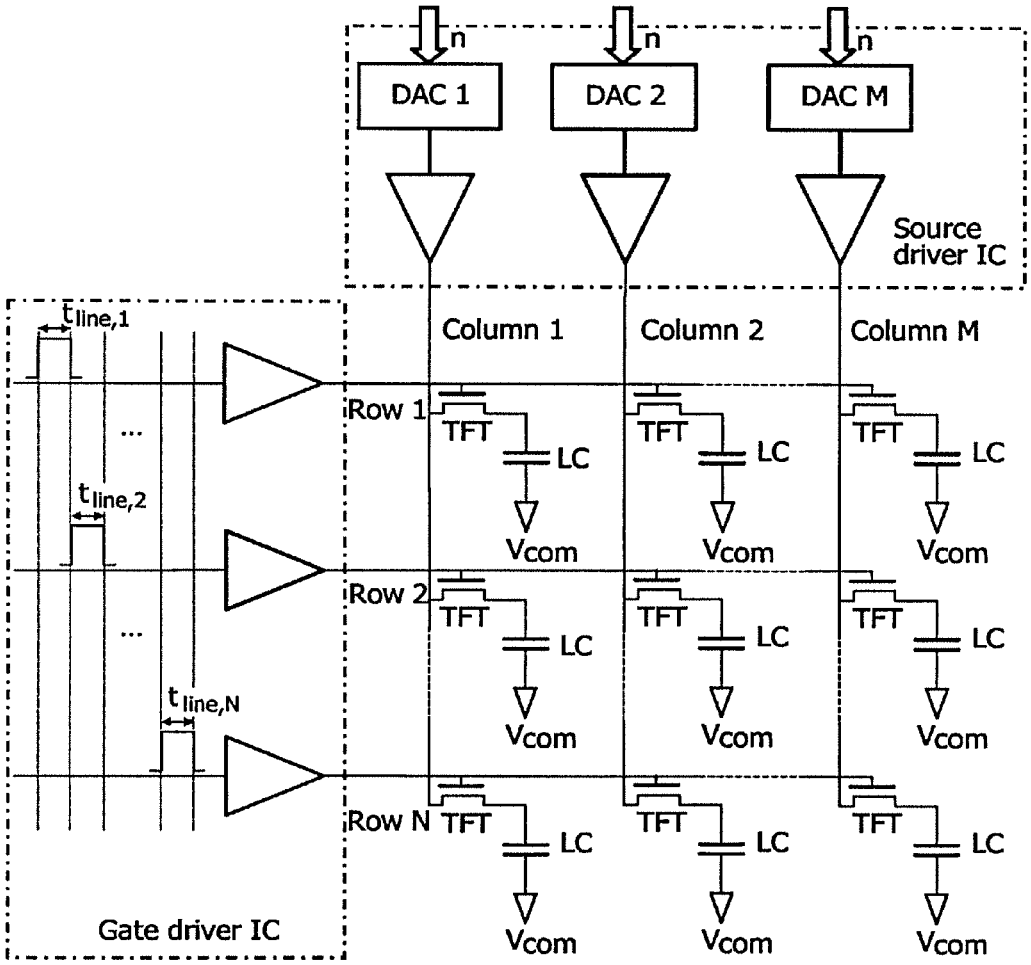
FIG. 1 (PRIOR ART)
FIG. 1 shows a known AMLCD screen with a resolution of N rows and M columns.

This drive scheme can be applied to a conventional LCD panel as shown in FIG. 1, with one common electrode. The approach can of course be applied to other active-matrix LCD panel configurations as well.

The current source 62 is used during a fixed amount of time tgrey. This means that even when the switch and column have series resistance (which is always the case), the correct amount of charge is fed to the column and pixel. Only the value of the capacitance of column and pixel (Cload) needs to be known to achieve the correct transmittance of the pixel.

The realisation of the voltage waveform on the column is very simple: only a current source needs to be connected to the column and pixel capacitance and the voltage waveform is generated by means of current integration.

Figure 7:
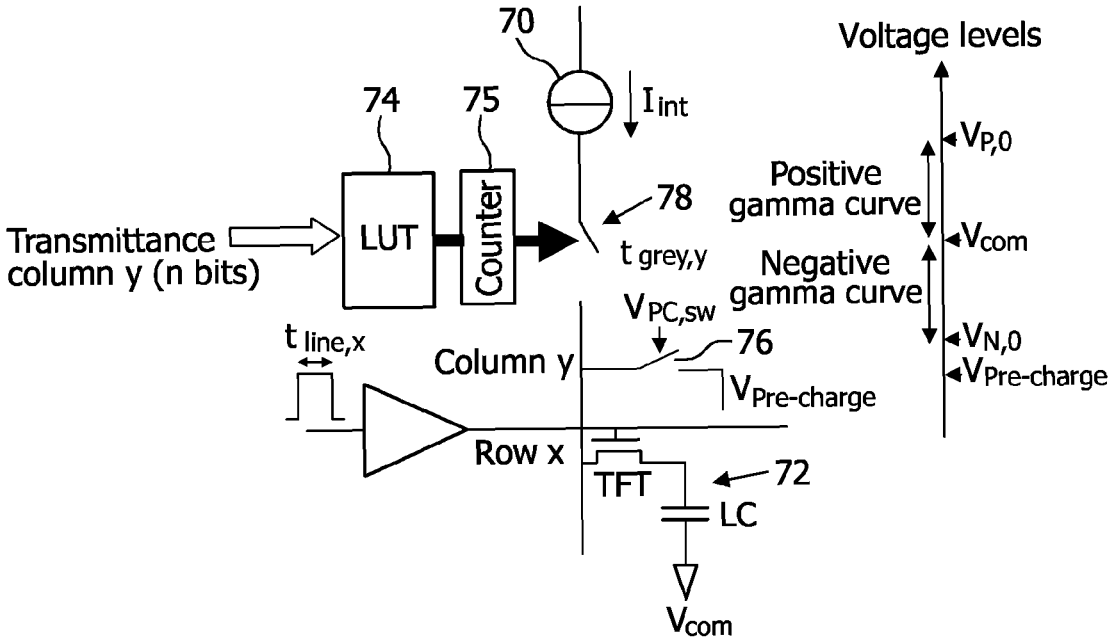
FIG. 7 shows a first detailed embodiment of the invention using a unipolar current source for each column.

A first embodiment is shown in FIG. 7. The current source 70 is unipolar, which means that in order to generate both positive and negative gamma voltages, the voltage waveform formed by current integration needs to run from at least VN,0 to VP,0 (these are the extremes of voltage levels required by the two polarity drives). When the current source can only flow in one direction, e.g. sourcing current as shown in FIG. 7 to the addressed pixel 72, the column needs to be pre-charged to the bottom (or top in case of a sinking current source) of the voltage range, VPre-charge in FIG. 7.

The transmittance information is translated into a time tgrey by means of a LUT 74, assuming a constant-current source for simplicity. Since the gamma curve is non-linear, a finer time grid on a linear scale can be used to realise all values on the non-linear gamma curve. In practice, a 13-bit linear grid may be appropriate to realise all values of a 10-bit non-linear gamma curve with sufficient accuracy. The 13-bit digital code is translated into a time value by the local counter 75 of each circuit. This counter 75 receives as input the digital data output from the LUT 74, and provides as output the time value tgrey. The counter is clocked by a reference clock signal.

Figure 8:
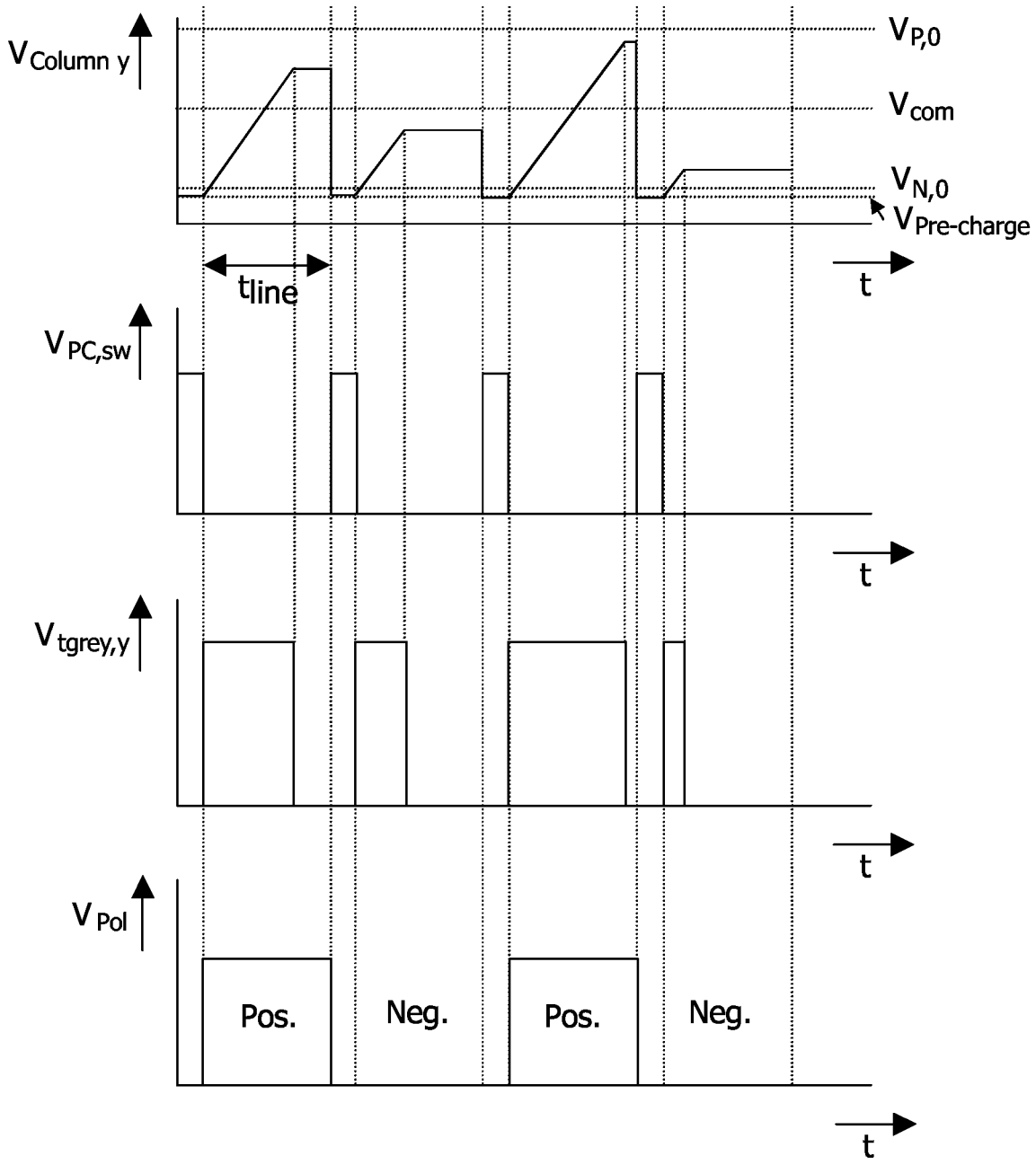
FIG. 8 shows waveforms for explaining the operation of the circuit of FIG. 7.

FIG. 8 shows possible waveforms to clarify the idea.

For the purpose of explanation, a 10-ms line addressing time can be assumed. For realisation of both the negative and positive gamma voltages during this time, both with a linear time grid resolution of 13 bits (to realise a non-linear resolution of 10 bits), 14 bits are needed to realise the total time grid. This implies a time grid of 600 ps, which is feasible with state-of-the-art IC processes used to implement the source driver IC.

The top plot in FIG. 8 shows the column voltage returning to the precharge voltage at the end of each line addressing time, and shows the column being charged to a voltage lying alternately in the two polarity ranges. The second plot in FIG. 8 shows the control of the precharge switch 76 (see FIG. 7), the third shows the control of the current source switch 78 (see FIG. 7) and the bottom plot shows a polarity control signal.

Figure 9:
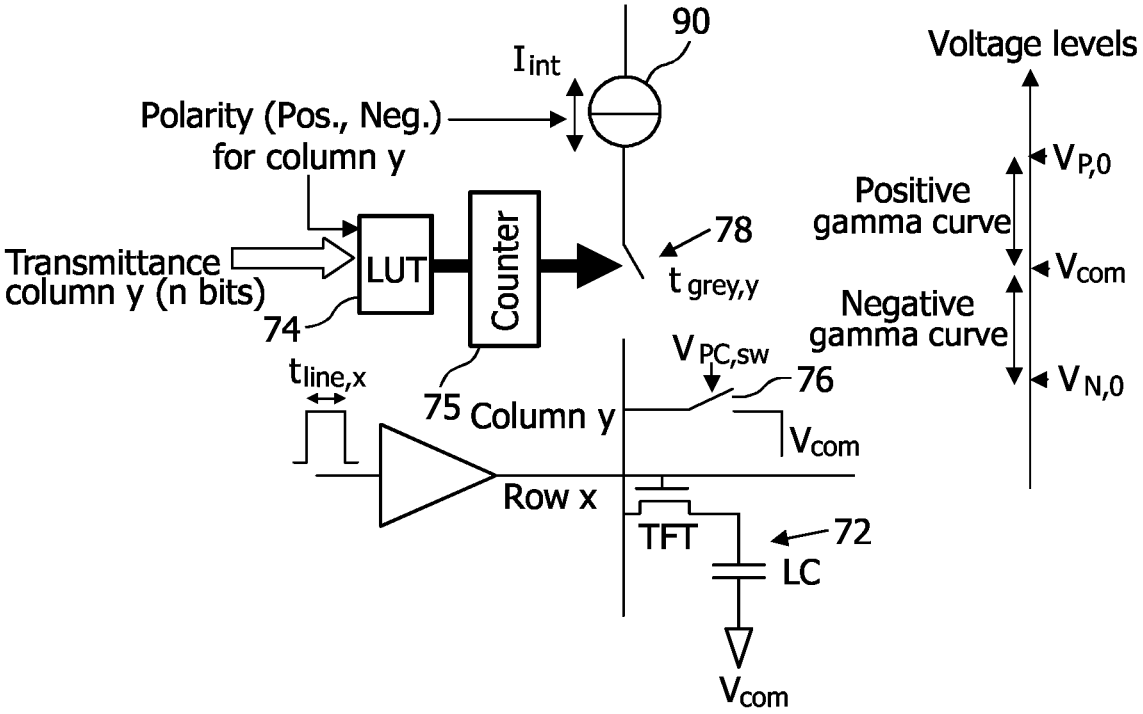
FIG. 9 shows a second detailed embodiment of the invention.

A second, and preferred, embodiment is shown in FIG. 9. A bipolar current source 90 is used so that the current lint can now flow in two directions, depending on the desired polarity. As shown, the polarity control signal thus controls the current source 90 and LUT 74. FIG. 9 otherwise corresponds to FIG. 7. Again, the bidirectional current sources can be implemented in many different ways.

Figure 10:
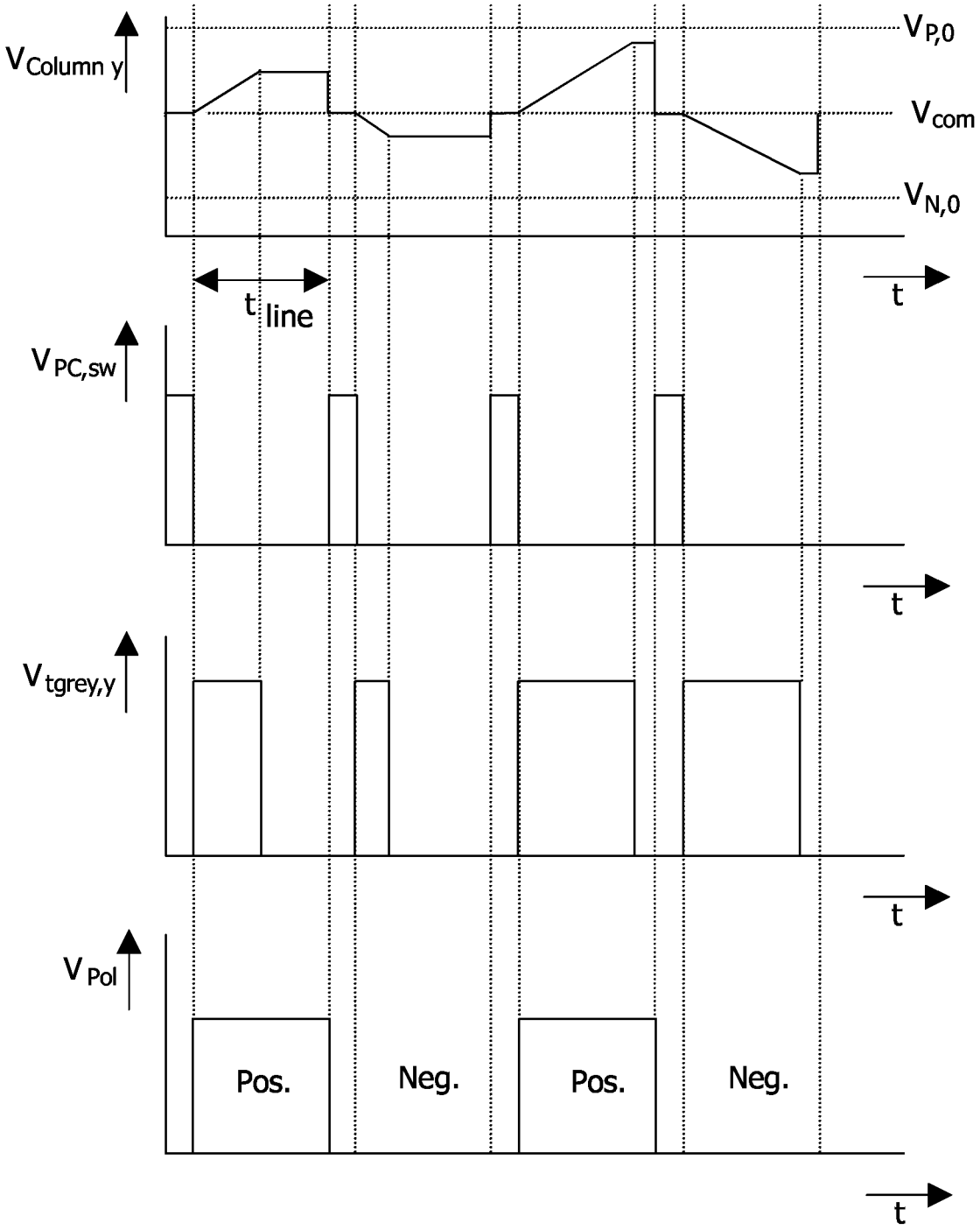
FIG. 10 shows waveforms for explaining the operation of the circuit of FIG. 9.

The pre-charge occurs to an intermediate voltage level Vcom. The main voltage waveforms for this embodiment are illustrated in FIG. 10, showing the same plots and desired transmittance levels as in FIG. 8.

There are a number of advantages of using a bipolar current source. The pre-charge level Vcom, can be an intermediate level, in the middle between the negative and positive gamma curves. This is more efficient, especially for positive gamma voltages, since the capacitor no longer needs to be charged starting from voltage VPre-charge lower than VN,0. FIG. 10 shows that the pre-charge is more efficient, since the variations in the column voltage are reduced.

A time grid that is a factor of two coarser compared to the time gird required for a unipolar source can now be used. Since the slopes of the ramps are less, the signals tgrey and/or the value of lint have also changed.

The influence of variations of parameters on the performance of the driver circuit is also made equal for negative and positive gamma curves. This leads to less image flicker, as will be explained below.

In both embodiments described above, a current lint is integrated in the column and pixel capacitance Cload for a time tgrey, determined by the LUT. Therefore, the current lint needs to be dimensioned based on the value of capacitance Cload such that the generated voltage waveform achieves the desired values for the corresponding tgrey values. In practical implementations, spread on both lint and Cload will lead to a deviation of the reached voltage values on the column and pixel. The effect of this spread is different for the two embodiments above.

This difference in the influence of spread on lint and Cload on the generated voltage waveform is depicted in FIG. 11 for the case of a constant current source, and hence a ramp voltage on Cload.

Figure 11A:
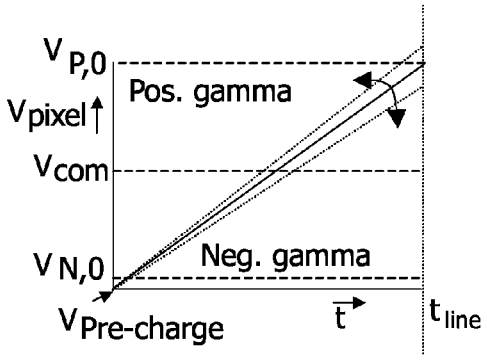
FIG. 11 shows differences in influence of lint and Cload variations on the generated voltage waveform on Cload (in case of constant lint), in which FIG. 11A relates to the embodiment of FIG. 7, FIG. 11B relates to the embodiment of FIG. 9.
FIG. 11C is a gamma curve showing the relationship between pixel voltage and brightness.
Figures 11B, 11C:
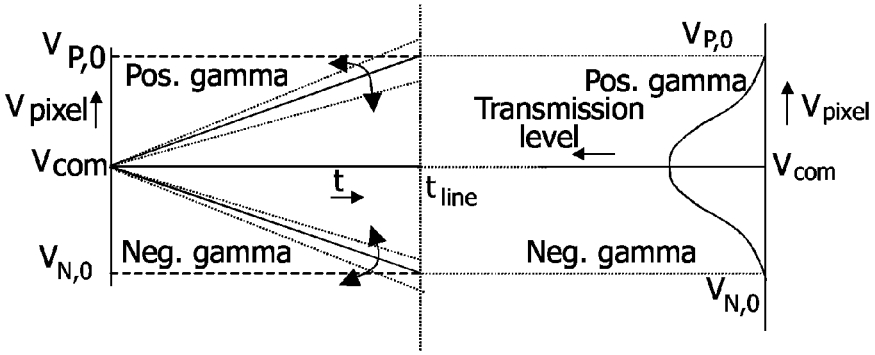

FIG. 11A relates to the embodiment of FIG. 7 and FIG. 11B relates to the embodiment of FIG. 9. FIG. 11C shows the gamma curve, linking pixel voltage to light transmission level.

Since the error accumulates due to the time integration, the error is largest at the end of the line addressing time tline. In case of a unipolar current source, the ramp has to run all the way from VN,0 to VP,0, and therefore the error is larger for the positive gamma curve than for the negative gamma curve. This can lead to undesired flicker, because of differences in transmittance levels for positive and negative frames. When a bipolar current source is used, this problem is overcome, since the errors for negative and positive gamma curve are now the same, as indicated in FIG. 11B.

Nevertheless, variations in the charge delivered to Cload (caused by variations in current lint due to IC spread) and in Cload itself influence the end value of the voltage on the pixel. The time values (tgrey) are obtained from a digital LUT, so these values do not vary after programming.

If the variations in end voltage value due to variations in current and/or load capacitance become considerable, they will lead to visible image artefacts. In such a case, a calibration scheme can be used to counteract the effects of variations in current and load capacitance. The actual shape of the gamma curve implies the largest sensitivity of voltage errors to light transmittance at about half the transmission level. A calibration scheme canm therefore adjust for such a transmittance level if desired.

Figure 12:
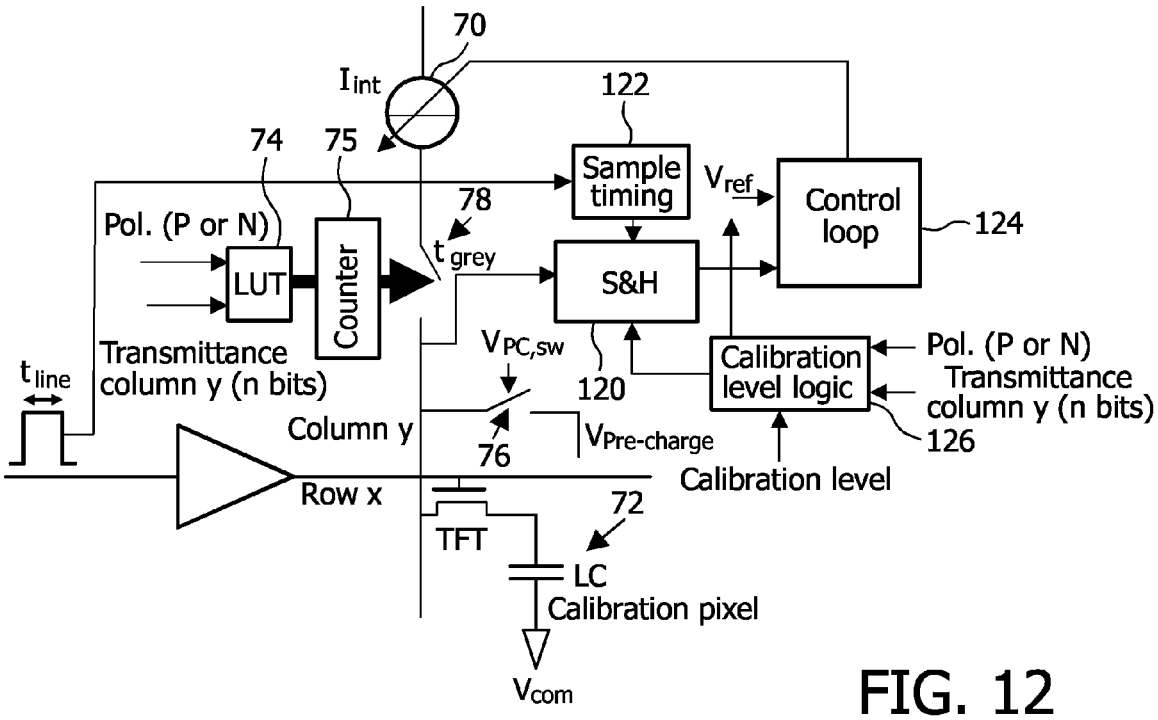
FIG. 12 shows a third detailed embodiment of the invention for implementing current source calibration.

FIG. 12 shows schematically a circuit for one column driver output for implementing a calibration scheme in accordance with the invention.

The circuit includes the pixel 72, LUT 74, current source 70, timing switch 78 and precharge switch 76 as in FIG. 7.

In addition, a sample-and-hold (S&H) circuit 120 is provided for sampling the column voltage, and with timing information derived from the row control pulses, using a timing unit 122. The S&H amplifier circuit 120 is used to provide data to a control loop 124 for controlling the current source 70. The control loop also uses input from a calibration logic unit 126.

The circuit of FIG. 12 is for analysing the response of a selected "calibration pixel". Several possibilities exist for defining which is the selected "calibration pixel". At the basis of the calibration scheme is the definition of a calibration transmission level. Since the expected variations in achieved transmission levels are largest at the edges of the gamma curve (near VN,0 and/or near VP,0, depending on unipolar or bipolar current source, as explained with reference to FIG. 11), choosing the calibration level at the edge of the gamma curve is preferred. This corresponds to a black pixel for 'normally-white' LCD screens. Of course other levels may also be chosen.

The basic principle of the calibration scheme will be explained with reference to FIG. 12, assuming a black calibration transmittance level for illustration purposes.

At the beginning of the line addressing time, the transmittance to which each individual pixel in the addressed row 'x' will be written is known, based on the incoming video data. This means that the voltage to which each individual column driver output 'y' must drive the addressed pixel is known. For each column where the transmittance level corresponds to the chosen calibration transmittance level (black in this example), the calibration loop will be activated. This is detected by the unit 126. Thus, any pixel that is written to black (in this given example) on row 'x', as defined in the incoming video data, can be used as the calibration pixel.

As described above, the driver output delivers a charge linttgrey to the column and pixel capacitance Cload. The value of this charge depends on the transmittance level.

Assuming that for the illustrated column y, the transmittance corresponds to the chosen calibration level, namely black in this example, the pixel is the "calibration pixel". The unit 126 then activates the S&H amplifier 120. The voltage on the column reached at the end of the line addressing time is then sampled by the S&H amplifier 120 and fed to a control loop. The S&H amplifier is required as the column output will attain various end values when writing the other lines during the frame time. The timing unit 122 ensures that the column voltage is sampled just before the gate signal goes low at the end of the line addressing time. The sampling of the column voltage may be implemented at other times, as mentioned above.

The sampled value of the column voltage is compared to a desired voltage value Vref in the control loop.

For example, this reference voltage can be either VP,0, for a black pixel with positive polarity, or VN,0, for a black pixel with negative polarity. The unit 126 also controls the selection of the correct reference voltage.

Based on the difference between the sampled column voltage and Vref the value of the current source lint is adjusted, thereby providing a calibration of the charge linttgrey delivered to the pixel by the driver output. The time constant in the control loop should be chosen to be large enough to ensure that current lint remains at the desired value.

The calibration scheme makes sure that the voltage on the load capacitance reaches the correct value, but does not require any change to the conversion of pixel drive voltage level to time value. Thus, a common mapping can be used for this purpose, and implemented as a single LUT (or identical LUTs on different ICs to reduce required interconnections between ICs).

The effectiveness of the calibration scheme as described above depends on how often pixels across the screen are written to black (or other selected calibration transmission level). The more pixels across the screen are written to black (in this example) during a frame time, the more effective the calibration scheme will be. However, situations may occur in which no pixels are written to black (in this example) for a substantial amount of time. In that case, using a dedicated calibration pixel, row or column at the edge of the screen can be used. This pixel, row, or column is continuously written to the calibration transmission level. The "transmittance column y" input to the LUT 74 is thus simply the calibration level, and the S&H amplifier 120 remains continuously activated. The 'transmittance column y' input to the unit 126 can also be omitted. The operation of the calibration loop remains the same.

Defining dedicated calibration pixels involves sacrificing a pixel, a row or a column on the LCD screen. When this pixel, row or column is written to black, as in the example described above, and is situated near the edge of the screen, no special precautions need to be taken, since a black line or column near the edge of the screen is not annoying to the user. An electrode at the very edge may be less representative of the panel than the second one from the edge, as it also has neighbouring electrodes at each side. Thus, dummy pixels may be at the edge or near the edge. For other colours related to other calibration transmission levels, the dedicated calibration pixels may be hidden behind the casing of the LCD screen.

A number of detailed implementations of the basic principle illustrated in FIG. 12 are possible. Three different design aspects are described below. Of course, various combinations of features described in connection with these aspects can be envisaged.

The different aspects relate to general implementation approaches (number of controlled current sources, possible use of dedicated calibration pixels, etc), the detailed implementation of the control loop (analog or digital) and detailed considerations for the calibration algorithms (number of calibration levels, unipolar or bipolar current source, etc.).

Many possible different general approaches for implementing the basic operation of FIG. 12 can be envisioned.

(i) Approaches which do not Use Dedicated Calibration Pixels

For approaches which do not require dedicated calibration pixels, the calibration circuitry shown in FIG. 12, including S&H, sample timing, calibration control logic and control loop can be added to each individual column output. In this case, each time a pixel is written to a pre-defined calibration transmission level in a column, depending on the incoming video data, the current source lint used in the column driver output is calibrated.

Depending on the expected variations in column and pixel capacitance Cload across the LCD screen, the additional calibration circuitry may only be added to one or several columns divided across the width of the screen. Based on the outcome of these calibration loop(s), all current sources in all column driver outputs can be controlled to the right value. The reason to use a limited number of control loops is to save silicon area.

Calibration circuitry may be added to one column only, but a calibration opportunity only then arises when a pixel in that column is written to the pre-defined calibration transmission level, depending on the incoming video data. This means that the number of calibration opportunities reduces, but this may not be a problem, depending on the expected variations in load capacitance. All current sources in all columns can then be controlled based on the difference between reached end voltage of the column used for calibration and the reference voltage.

If more than one column is used for calibration, the current sources of the other columns can be controlled in groups around the columns used for calibration.

When calibration circuitry is added to a limited number of columns to save area, all current sources can be calibrated simultaneously based on a difference between the average of end voltages attained in the calibration columns and the reference voltage. During each frame time, depending on the incoming video data, any number ranging from none to all of the calibration columns would deliver inputs to the averaging circuit. This allows averaging of the effect of load capacitance variations across the screen, which may be beneficial depending on the screen characteristics.

In cases where the column capacitance is dominant in determining the load capacitance, a pixel need not be connected to the driver output to calibrate for Cload, since Cload is determined predominantly by the column capacitance. In that case, one additional time slot, equal in duration to the line addressing time, can be added within each frame time period. During this additional time slot, all TFTs are left switched off, to prevent any pixel voltage from being influenced by the calibration cycle.

The calibration cycle then involves charging all columns to the calibration voltage level and checking the voltage end values. The calibration loop only then needs to be activated during the calibration cycle. Again, anything from one calibration loop in a single column controlling all current sources in all column outputs, to calibration loops in all individual column driver outputs may be used.

Figure 13:
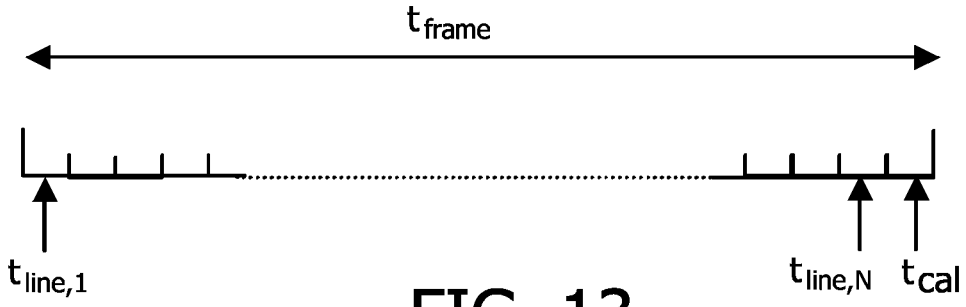
FIG. 13 is used to explain how an additional time slot can be used for calibration.

A possible timing diagram of this embodiment is given in FIG. 13 for N rows and calibration time tcal, which may be placed at any time instant during the frame time. The calibration time slot has been placed at the end of the frame time for illustration purposes.

(ii) Approaches which Use Dedicated Calibration Pixels

Many different approaches are also possible when one or more dedicated calibration pixels are used. The advantage of having a dedicated calibration pixel, row or column is that calibration will certainly occur every frame time, since every frame time this calibration pixel(s) are driven to the calibration transmittance level.

A first possibility is to use one calibration pixel at the edge of the LCD screen. Each frame time, this pixel is driven to the calibration transmittance level, e.g. black. The user will not see the resulting black spot at the edge of the screen. The disadvantage is that Cload variations at only one screen position are taken into account.

A second possibility is to use one calibration column. This is approach is shown in FIG. 14.

The column driver circuit 140 has adjustable current sources 142 for each column, but only one column current source 142A has a feedback loop.

Figure 14:
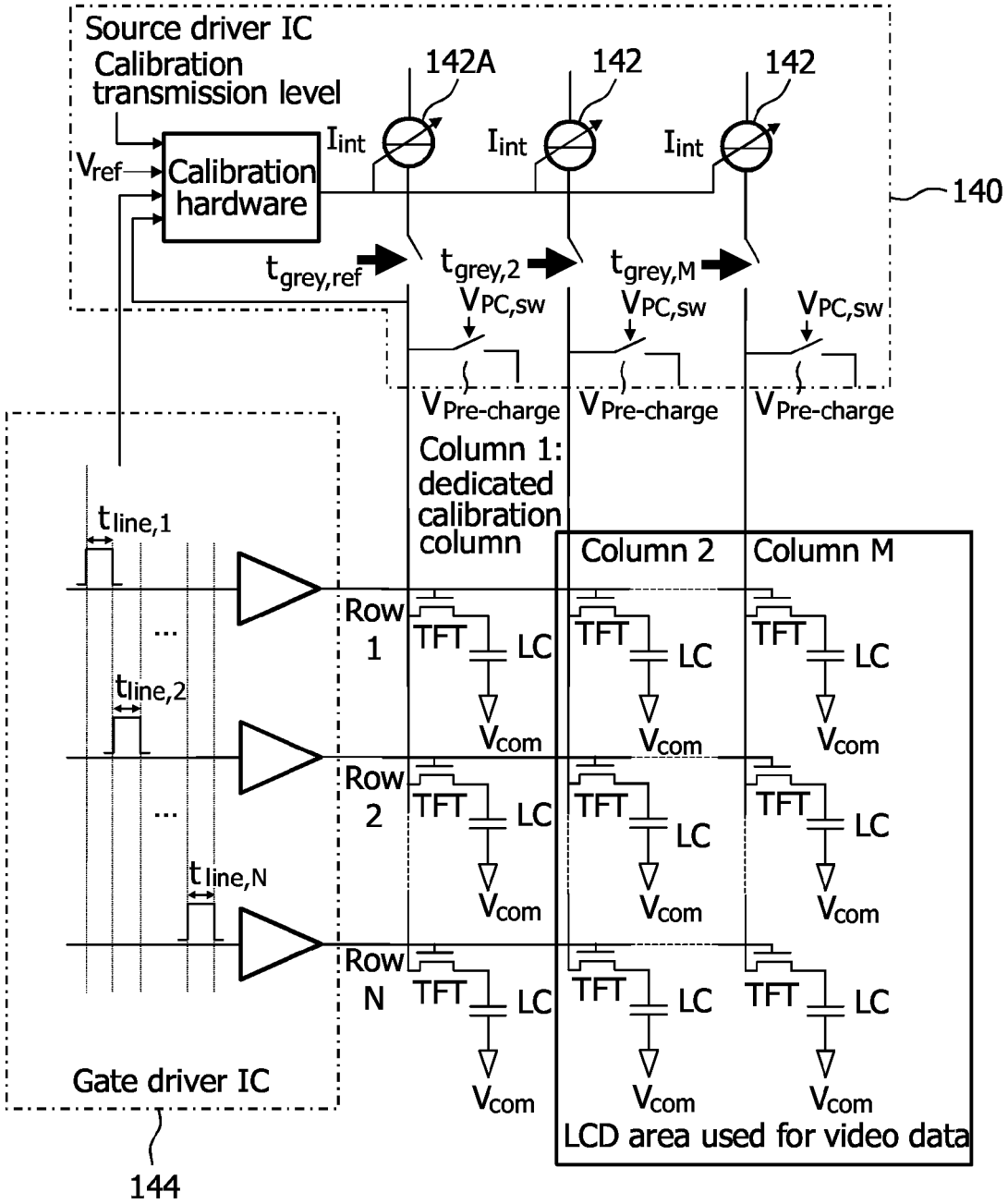
FIG. 14 shows a fourth detailed embodiment of the invention for implementing current source calibration in which a column is dedicated to calibration.

In FIG. 14, column number 1 at the edge of the screen has been sacrificed as a calibration column. Each line time, one pixel in the column is written to the calibration transmittance level. The calibration column is written to the calibration transmittance value every line time and the circuit calibrates its own output current and all current sources of the other column outputs that are used to write video data to columns 2 . . . M.

When the time constant in the calibration control loop is large enough, variations in Cload when writing different rows on the LCD screen are averaged out.

The line addressing signals of the row drivers 144 are used as input for the calibration control loop to control the sample timing. The reference voltage Vref and time tgrey depend on the polarity of the calibration pixel that is written to, as explained above, as well as on the chosen calibration level (e.g. Vref=VN,0 for negative polarity of a black reference level).

In this case, the user may see a black line at the side of the screen. As explained above, other calibration transmittance levels may also be used, and it may be desirable to hide the column behind the casing. Of course more than one calibration column may be used, for example one on the left side and one on the right side of the screen.

A third possibility is the use of one calibration row at the top or bottom of the screen. This is similar to defining a calibration column. Each frame time, the row is driven to the calibration transmission level during an additional row time, in a similar manner to time tcal in FIG. 13. The user may see a black row at the top or bottom edge of the screen (or both). This scheme enables variations in Cload along the width of the screen to be taken into account.

These implementations can be extended to include any number (from 1 to M) of calibration loops. Of course, dedicated calibration columns and rows can be combined, e.g. two rows, one at the top and one at the bottom, and two columns, one to the left and one to the right.

There are various advantages and disadvantages of the use of dedicated calibration pixel, some of which are outlined above. Further issues will now also be discussed.

Without dedicated calibration pixels, variations in the capacitances all over the LCD screen may be taken into account, depending on how often and where pixels are written to the calibration transmittance value. This makes the calibration effectiveness dependent on the video data. This is not the case when using dedicated calibration pixels, but since these have to be placed at the edge of the screen in order not to disturb the picture, only variations in capacitance at the edge of the screen are taken into account. A calibration line inside the LCD area used for video data could also be used for calibration, if the backlight is arranged to be off at that moment. This could be applied during start-up, or could be used in a system employing scanning backlight techniques. This combines the advantage of being able to take into account capacitance variations all over the screen with the advantage of not being dependent on video data for calibration effectiveness.

The control loop can be implemented in the analogue or digital domain.

Figure 15:
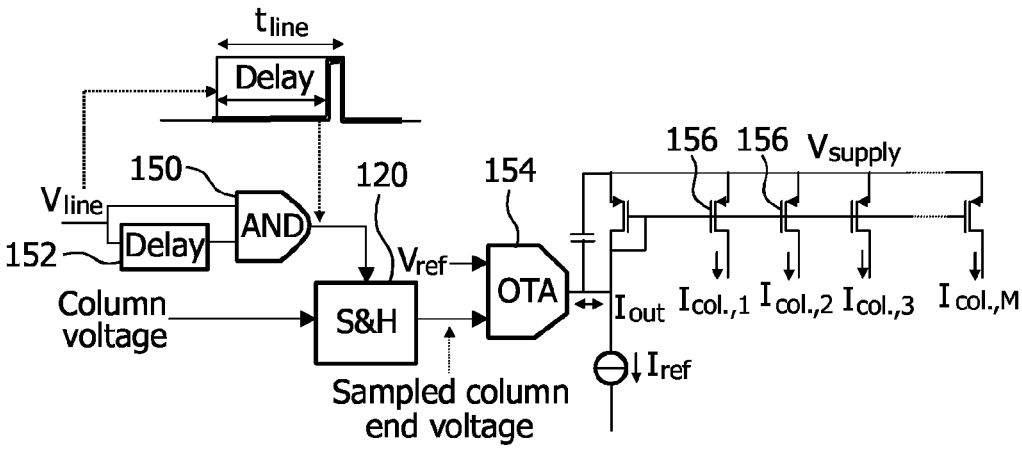
FIG. 15 shows an analog control loop for calibration of current values based on a difference between sampled column end voltage and a reference voltage.

A possible embodiment of the control loop implemented in the analog domain is shown in FIG. 15.

The sample timing block 122 of FIG. 12 is implemented with an AND port 150 and a delay block 152. This means the S&H circuit is activated only at the end of the line time. This is just one example of how this could be implemented. The line addressing signal Vline for the line on which the calibration pixel is situated, which is 'ON' for the duration of the line addressing time tline (see also FIG. 12), is used as input. The AND port issues a pulse at the end of the line addressing time, as shown in bold in FIG. 15, which is fed to the S&H amplifier 120.

The sampled end value of the column voltage, just before the end of the line addressing time, is fed to an Operational Transconductance Amplifier (OTA) 154. The other input of the OTA 154 is connected to the reference voltage Vref.

In the ideal case, the sampled column end voltage equals the reference voltage and zero output current Iout flows from the OTA. If there is a difference, the output current of the OTA adds to or subtracts from a reference current Iref at the input of a current mirror. The outputs Icol.,i of current mirror circuits 156 that are used in the individual column driver outputs.

The type of scheme being implemented, as discussed above, determines the number of controlled current sources, and thus the number of control loops needed as well as the number of outputs of the current mirror. FIG. 15 shows current-mirror outputs for all columns 1 . . . M.

The addition of a reference current is suitable for unipolar current sources. For bipolar current sources, two control loops are needed, as discussed further below.

Figure 16:
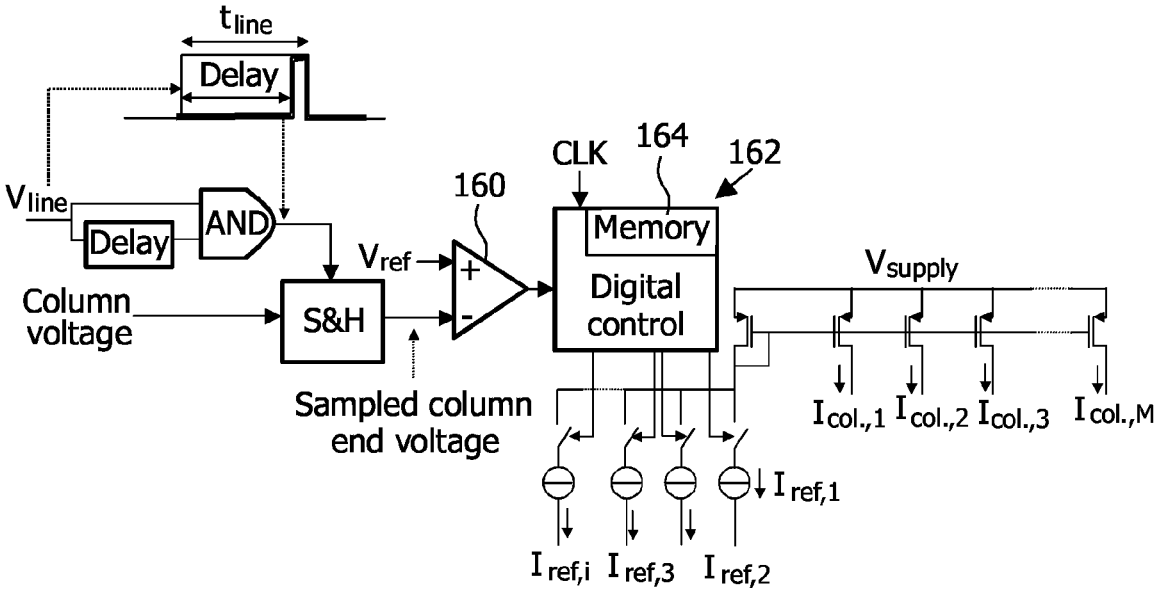
FIG. 16 shows a digital control loop for calibration of current values based on a difference between sampled column voltage and a reference voltage.

FIG. 16 illustrates a digital implementation of the control loop.

The same sample timing block using a delay block and AND port is shown in FIG. 16. In the illustrated example, a comparator 160 is used instead of an OTA to compare the sampled column end voltage to the reference voltage. A digital output of the comparator informs a digital control block 162 whether the column voltage and hence the column output current is too low or too high. In case the current is too low, the controller can add an additional reference current Iref,i at the input of the current mirror. In case the current is too high, one or more reference currents may be switched off. The digital controller uses a system clock and a memory 164, which is used to store the latest actions of the controller. For example, when the output of the comparator has indicated three times in a row that (for example) the current is too low, the number of additional reference sources that is switched on may be increased to increase the response time. The reference current sources may be coded in value, e.g. a binary coding may be applied, making the second reference current twice the LSB current, the third one four times the LSB current, etc. Other embodiments where current sources are added to or subtracted from a fixed reference current source are also possible.

The output of the digital controller 164 can also be connected to any suitable DAC function, replacing the switched current sources.

Numerous implementations of digital control loop are possible, for example including the use of two comparators as a dead-band controller. In that case, the difference between the sampled column end voltage and the reference voltage is kept between two closely separated reference levels. Again two control loops are needed when a bipolar current source is used in the column driver sections.

When a unipolar current source is used per column, the value of the single current source can be adjusted by a control loop using a single reference voltage as indicated above. As shown in FIG. 11A, the possible deviation in column voltage is largest for the positive gamma curve in this case (or the negative gamma curve in case the opposite current direction is used). Therefore, in a preferred embodiment for a calibration loop for unipolar current sources, the calibration pixel is driven to VP,0 (or VN,0 in case the opposite current direction is used) for all frames and the current source is calibrated to reach this voltage within a defined accuracy in exactly the line addressing time.

When a bipolar current source is used in each column, two current sources are effectively used per column, one for sinking current and one for sourcing current. Depending on the column polarity, either the sinking or the sourcing current source is calibrated. An example is shown in FIG. 17.

Figure 17:
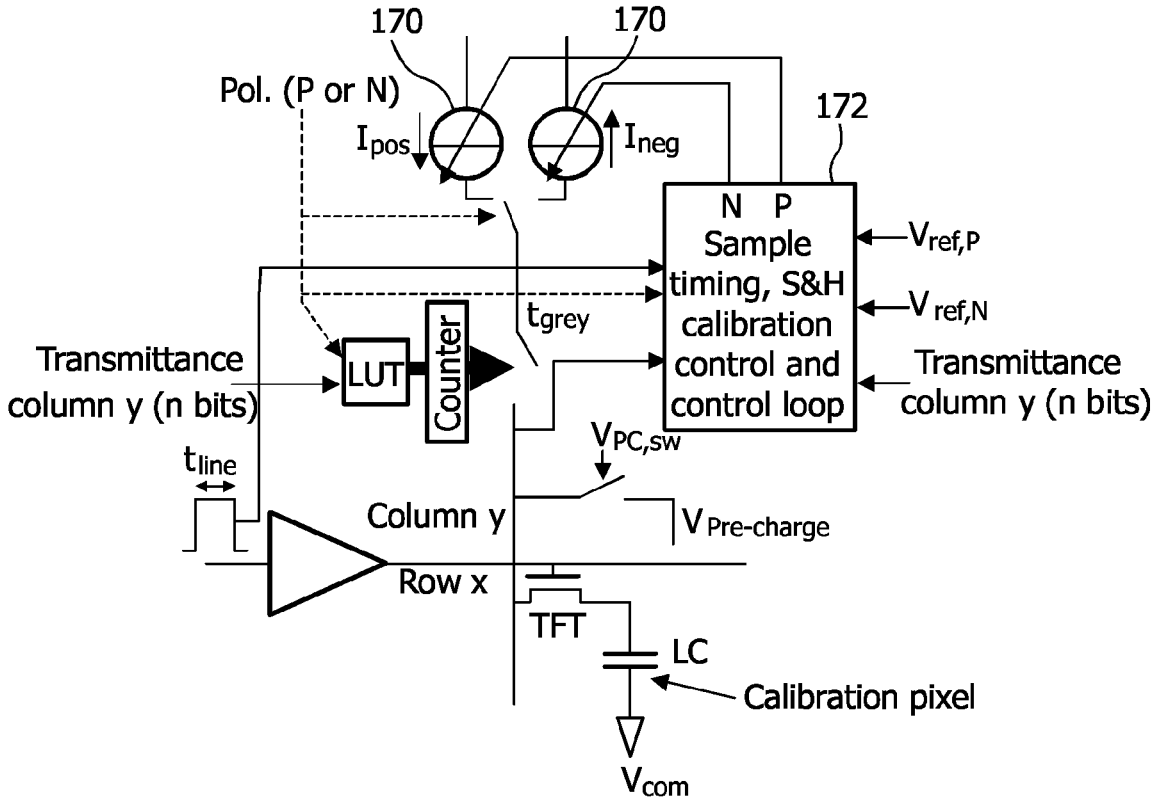
FIG. 17 shows a calibration loop for use with a bipolar current source for one column.

FIG. 17 shows the current source circuit for one "calibration pixel", and comprising two parallel current sources 170. All elements of the feedback control circuit are shown schematically as block 172.

As can be seen in FIG. 17, current source Ipos is used for sourcing current to charge the column and pixel to voltages higher than pre-charge voltage VPre-charge in positive frames (polarity P). Likewise, current source Ineg is used in negative frames to discharge column and pixel capacitance to voltages lower than pre-charge voltage VPre-charge, (polarity N). The polarity to which the calibration pixel is written, P or N, also determines which time tgrey is used for the sample switch, which reference voltage, corresponding to the chosen calibration level, is used (e.g. Vref,P=VP,0 for positive frames, black calibration level, Vref,N=VN,0 for negative frames, black calibration level) and which control output (P for positive frames, N for negative frames) of the control loop is used.

The embodiments described above use a single calibration level for each frame, e.g. VP,0 for positive frames and black calibration level, and VN,0 for negative frames and black calibration level. In fact, any calibration level can be used, or even multiple calibration levels. In the latter case, a level generator can be used to determine a calibration transmission level from frame to frame.

There are numerous further possible variations to the embodiments described above. An unipolar current source with a conditional pre-charge can be used. The column is then pre-charged to either VPre-charge, when the polarity is negative, or to Vcom, when the polarity is positive. This also has a positive influence on the time grid, which may become a factor of two coarser, since the ramp only has to cover the range VN,0-Vcom for negative polarity or Vcom-VP,0 for positive polarities.

Since the positive and negative gamma curve may differ, the LUT in the embodiments above can actually include two sub-LUTs, one implementing the negative gamma curve and one implementing the positive gamma curve. Which sub-LUT is used for a certain frame depends on the desired polarity, hence on the value of Vpol.

In addition to implementing the colour depth in the time domain by defining the value of tgrey based on the desired transmittance, the value of the current source lint can also be made variable. In this way, any voltage waveform can be generated. The LUT is then used to translate the desired transmittance level into a combination of lint and tgrey. However, a single mapping operation is still provided for all column driver current source circuits.

The column capacitance does not have to be charged by a pure current source, and the current source can be implemented as a voltage source with a series impedance, providing the series resistance does not become dominant or significant compared to the load capacitance.

The invention is of particular advantage for source driver ICs for AMLCD panels, and enables production of simple, small area source drivers for displays with moderate colour depths. The invention can also be used to realize higher colour depths, without the dramatic increase in circuit area. The invention enables a large spread in driver output current and load capacitance across the screen to be tolerated.

Various other modifications will be apparent to those skilled in the art.

The invention claimed is:

1. An active matrix liquid crystal display device comprising:

an array of pixels arranged in rows and columns, each pixel comprising a liquid crystal cell;

a column driver circuit for providing pixel drive signals to the columns of pixels, wherein the column driver circuit comprises an array of current source circuits, a respective current source circuit being provided for each column of pixels, wherein each current source circuit comprises:

a current source; and a supply switch for controlling the time during which the current source supplies current to or drains current from the column, and wherein the device further comprises a mapping means for deriving a digital value from the transmittance of the liquid crystal cell, wherein the digital value represents a time period for the control of the supply switch of each current source circuit, the mapping means implementing a single mapping function for use in providing the digital values for all current source circuits;

wherein the column driver circuit is adapted to apply a polarity inversion scheme such that the current source is controlled to supply current to or drain current from the column thereby generating a voltage corresponding to a positive gamma curve and a voltage corresponding to a negative gamma curve on a capacitor of the liquid crystal cell alternately.

2. A device as claimed in claim 1, wherein the mapping means comprises a look-up table.

3. A device as claimed in claim 1, wherein each current source circuit further comprises a counter for converting the digital value into a time value.

4. A device as claimed in claim 1, wherein each current source circuit comprises a precharge switch for connecting the column to a precharge voltage.

5. A device as claimed in claim 1, wherein the current source of each current source circuit comprises a unipolar current source.

6. A device as claimed in claim 1, wherein the current source of each current source circuit comprises a bidirectional current source.

7. A device as claimed in claim 1, wherein the current source of each current source circuit supplies or drains a constant current over time.

8. A device as claimed in claim 1, further comprising means for identifying at least one calibration pixel for use in calibrating the current sources of the current source circuits.

9. A device as claimed in claim 2, wherein the look-up table stores digital values representing time having more bits than the number of bits corresponding to the number of colour levels of the display device.

10. A device as claimed in claim 4, wherein the precharge voltage is below the lowest pixel drive voltage or above the highest pixel drive voltage.

11. A device as claimed in claim 4, wherein the precharge voltage is between the lowest pixel drive voltage and the highest pixel drive voltage.

12. A device as claimed in claim 8, wherein the calibration pixel is identified as one which is driven to a predetermined drive level.

13. A device as claimed in claim 8, further comprising sample-and-hold circuitry for storing a drive voltage which results in the calibration pixel after addressing the pixel.

14. A device as claimed in claim 8, wherein the means for identifying is for identifying a plurality of calibration pixels, and wherein each respective calibration measurement is for controlling the current source circuits of a respective group of columns.

15. A device claimed in claim 8, wherein the calibration pixel or pixels comprise a dedicated calibration pixel or pixels outside a normal pixel display area.

16. A device as claimed in claim 12, wherein the predetermined drive level is a maximum or minimum drive level.

17. A device as claimed in claim 13, further comprising means for adjusting the current output of the current sources of the current source circuits in response to the drive voltage.

18. A method of driving the pixels of a liquid crystal active matrix display device comprising an array of pixels arranged in rows and columns, the method comprising:

deriving a digital value representing a time period for each column from the transmittance of the liquid crystal cell for each column using a common mapping of the transmittance of the liquid crystal cell to digital values;

driving an array of current source circuits, with a respective current source circuit for each column of pixels, each pixel comprising a liquid crystal cell, each current source circuit being driven for the time value corresponding to the respective digital value; and applying a polarity inversion scheme when driving the array of current source circuits such that the current source is controlled to supply current to or drain current from the column thereby generating a voltage corresponding to a positive gamma curve and a voltage corresponding to a negative gamma curve on a capacitor of the liquid crystal cell alternately.

19. A method as claim in claim 18, wherein deriving a digital value comprises addressing a look-up table.

20. A method as claimed in claim 18, further comprising, before driving the array of current source circuits, connecting the column to a precharge voltage.

21. A method as claimed in claim 18, wherein driving the array of current source circuits comprising supplying or draining a constant current over time.

22. A method as claimed in claim 18, further comprising: identifying at least one calibration pixel for use in calibrating the current source circuits.

23. A method as claimed in claim 22, wherein the calibration pixel is identified as one which is driven to a predetermined drive level.

24. A method as claimed in claim 22, further comprising storing a drive voltage which results in the calibration pixel after addressing the pixel.

25. A method as claimed in claim 22, further comprising adjusting the current output of current source circuits in response to the drive voltage.

26. A method as claimed in claim 22, comprising identifying a plurality of calibration pixels, and further comprising controlling the current source circuits of a respective group of columns based on each calibration pixel.

27. A method as claimed in claim 23, wherein the predetermined drive level is a maximum or minimum drive level.

* * * * *